US009809907B2

(12) United States Patent
Rodgers et al.

(10) Patent No.: US 9,809,907 B2
(45) Date of Patent: Nov. 7, 2017

(54) CARPET FIBER POLYMERIC BLEND

(75) Inventors: John A. Rodgers, Hixson, TN (US); James L. Williams, Marietta, GA (US); Dhanraj Jain, Kennesaw, GA (US)

(73) Assignee: Mohawk Carpet, LLC, Calhoun, GA (US)

( * ) Notice: Subject to any disclaimer, the term of this patent is extended or adjusted under 35 U.S.C. 154(b) by 1349 days.

(21) Appl. No.: 11/619,075

(22) Filed: Jan. 2, 2007

(65) Prior Publication Data

US 2008/0157425 A1 Jul. 3, 2008

(51) Int. Cl.

| | |
|---|---|
| ***B28B 3/20*** | (2006.01) |
| ***C08L 29/00*** | (2006.01) |
| ***D01F 1/07*** | (2006.01) |
| ***D01F 6/92*** | (2006.01) |

(52) U.S. Cl.
CPC . *D01F 1/07* (2013.01); *D01F 6/92* (2013.01)

(58) Field of Classification Search
USPC ..... 442/347; 528/359
See application file for complete search history.

(56) References Cited

U.S. PATENT DOCUMENTS

| | | | | |
|---|---|---|---|---|
| 4,410,473 | A | 10/1983 | Iohara et al. | |
| 4,475,330 | A | 10/1984 | Kimura et al. | |
| 5,120,768 | A * | 6/1992 | Sisson | 521/46.5 |
| 5,620,797 | A | 4/1997 | Mallonee | |
| 5,645,782 | A | 7/1997 | Howell et al. | |
| 5,662,980 | A | 9/1997 | Howell et al. | |
| 5,811,040 | A * | 9/1998 | Mallonee | 264/78 |
| 5,958,548 | A * | 9/1999 | Negola et al. | 428/92 |
| 6,109,015 | A | 8/2000 | Roark et al. | |
| 6,113,825 | A | 9/2000 | Chuah | |
| 6,627,310 | B2 | 9/2003 | Lee et al. | |
| 6,663,977 | B2 | 12/2003 | Kurian et al. | |
| 6,921,803 | B2 | 7/2005 | Chang et al. | |
| 2002/0127939 | A1 * | 9/2002 | Hwo et al. | 442/347 |
| 2004/0076823 | A1 | 4/2004 | Yoshimura et al. | |
| 2004/0214984 | A1 * | 10/2004 | Keep et al. | 528/359 |
| 2005/0109418 | A1 | 5/2005 | Liao | |
| 2006/0183829 | A1 | 8/2006 | Fujimoto et al. | |
| 2006/0240217 | A1 * | 10/2006 | Foss et al. | 428/97 |

FOREIGN PATENT DOCUMENTS

| | | |
|---|---|---|
| JP | 57193536 | 11/1982 |
| JP | 58180612 | 10/1983 |
| JP | 2003082553 | 3/2003 |
| JP | 2003089926 | 3/2003 |
| JP | 2004285108 | 10/2004 |
| JP | 2005179810 | 7/2005 |
| JP | 2005264357 | 9/2005 |
| JP | 2006002258 | 1/2006 |
| KR | 2001-0057095 | 7/2001 |
| KR | 2003-0055471 | 7/2003 |
| WO | WO 00/15886 | 9/1999 |
| WO | WO 03062511 | 7/2003 |

OTHER PUBLICATIONS

Marcinčin, Anton; Hricová, Marcela; Aneja, Arun; Andrejková, Alexandra; Körmendyová, Eva. Journal of Macromolecular Science: Physics, Sep./Oct. 2006, vol. 45 Issue 5, p. 945-956, 12p, 2 Black and White Photographs, 5 Charts, 4 Graphs; DOI: 10.1080/00222340600796223; (AN 22255122).*

Revised Petition to Establish a New Generic Subclass for PTT, filed before The Office of Secretary Federal Trade Commission, in Sep. 2006.*

Oppermann et al., Properties and morphology of polyester blends and fibers made therefrom. Chem. Fiber Int. 1999, 49, 33-35.*

Hwo, et al., "Nonwovens from Poly(trimethylene terephthalate) staple," Book of Papers—International Nonwovens Technical Conference, Dallas, TX, Sep. 26-28, 2000, 32. 1-32.20, Publisher: INDA, Association of the Nonwoven Fabrics Industry, Cary, NC.

Marcincin, et al., "Microscopic Evaluation of the Phase Structure of Fibers Based on a Polypropylene/Polyester Polymer Blend," *Vlakna a Textil*, 2005, pp. 57-62, vol. 12, No. 2.

Oppermann, et al., "Properties and Morphology of Polyester Blends and of Fibers Made Therefrom," *Chemical Fibers International*, 1999, pp. 33-35, vol. 49.

Reese, "Fibres to Finished Fabrics" Papers presented at the Fibre Science/Dyeing and Finishing Groups, Joint Conference, Prestbury, United Kingdom Dec. 7-8, 1999, Paper No. 2/1-Paper No. 2/11. Publisher: Textile Institute, Manchester, UK.

Yang, et al., "Dyeing of PTT/PET Blends," *AATCC Review, American Association of Textile Chemists and Colorists*, 2002, pp. 54-59, vol. 2, No. 8.

* cited by examiner

*Primary Examiner* — Jennifer Chriss
*Assistant Examiner* — Ricardo Lopez
(74) *Attorney, Agent, or Firm* — Alston & Bird LLP

(57) ABSTRACT

The invention provides carpet fibers prepared from a blend of polymeric components, said fiber exhibiting improved properties, such as improved spinnability and improved fire resistance. The carpet fibers particularly comprise a majority of polytrimethylene terephthalate (PTT) and a minority of polyethylene terephthalate (PET). The invention further provides yarns and carpets prepared from the inventive fibers, said yarns and carpets likewise exhibiting improved properties. The invention also provides methods of improving various physical properties (such as fire resistance, spinnability, and elongation) of a polymeric composition.

26 Claims, No Drawings

CARPET FIBER POLYMERIC BLEND

FIELD OF THE INVENTION

The invention relates to polymeric fiber blends, and particularly fiber blends useful in carpet yarns and carpets. The invention further relates to methods of improving physical characteristics of polytrimethylene terephthalate carpet fibers through preparation of polymeric blends.

BACKGROUND

Carpets, rugs, mats, and like floor coverings used in home and industrial applications are typically made from natural fibers (such as cotton and wool) or synthetic fibers (such as nylon, polyester, polyolefins, acrylics, rayon, and cellulose acetate). Synthetic fibers tend to be more favored in carpet manufacture, as they are generally more commercially acceptable and can be used for a wider variety of applications.

Nylon is often used in carpet fiber since it is strong, easy to dye, and readily available. Nylon carpeting can be disadvantageous, however, as it generally requires various treatments in light of its susceptibility to developing static electric charges and its ease of staining. Carpets made from polyolefins, such as polypropylene, are very resistant to staining and are naturally antistatic; however, polypropylene is a more rigid and less resilient fiber and will not generally maintain its appearance or shape under prolonged or heavy use, or after repeated deformations.

Polytrimethylene terephthalate (PTT) is a favorable alternative to both nylon and polyolefins. In particular, PTT is known to provide stain resistance, static resistance, and improved dyeability while also providing a "wool-like" feel with good physical performance.

Carpeting, whether used in home or industrial applications, preferably has a high degree of fire resistance. Although PTT has many desirable properties for use in carpet fibers, the degree of fire resistance exhibited by PTT is not as favorable as other synthetic fibers. Numerous procedures have been proposed for improving the fire resistance of melt extruded filaments or fibers used in the textile industry, such as in carpet construction. One procedure to improve fire resistance has been to extrude polymeric fibers or filaments incorporating flame retardant materials into the raw polymer. This can be undesirable, however, as the incorporation of such flame retardant materials can result in finished polymers having undesirable properties, such as altered color, as well as sensitivity to heat and light. There have been attempts to overcome such problems while still improving the fire resistance of polymeric carpet fibers. For example, U.S. Pat. No. 5,024,869 proposes incorporating organic pigments and dyes, such as carbon black. Despite such efforts, however, there still remains a need for carpet materials having improved fire resistance.

Typically, in preparing carpet fiber from PTT, an extruded fiber is drawn at an elevated temperature and spun into bulk continuous filament (BCF) yarn. Preparing PTT filament by conventional spinning processes can have problems, such as frequent breakouts during spinning and drawing, dusting during production processes, and formation of yarns having low quality and poor consistency. Thus, it would also be advantageous to provide a polymeric carpet material having improved spinnability and like properties.

SUMMARY OF THE INVENTION

The present invention provides carpet fibers or filaments comprising polymeric blends providing improved properties, such as improved spinnability and improved fire resistance. In particular, the invention provides polymeric fibers or filaments comprising PTT blended with one or more additional polymeric components in an amount such that the finished fiber exhibits improved properties in relation to a like carpet fiber consisting of PTT alone.

In one particular embodiment, the carpet fibers of the invention comprise PTT and polyethylene terephthalate (PET). Polyethylene terephthalate has natural and permanent stain resistance as well as strength and abrasion resistance comparable to nylon. Another benefit of PET in the preparation of carpet fiber is that the fiber can be made, at least partially, from recycled plastic, such a drink containers. Only according to the present invention, however, has it been found that PTT carpet fiber can be made to have improved properties through incorporation of PET.

The present invention provides carpet fibers having all of the desirable properties of PTT yet also including the desirable properties of PET. What could not have been predicted, however, is that various properties of PTT fiber can actually be improved by incorporating PET into the PTT fiber. For example, in one embodiment, the fire resistance of a PTT fiber can be improved by incorporating PET into the PTT fiber. In particular, it could not have been predicted that including even a small amount of PET into a PTT polymer could improve the fire resistance of a carpet fiber extruded from the polymeric mixture. In another embodiment, the spinnability of a PTT fiber can be improved by incorporating PET into the PTT fiber.

The present invention provides a further advantage in that the improved properties can be achieved while also decreasing the overall cost of the carpet fiber. As noted above, PET is particularly advantageous in that is can be recovered from previously prepared materials (e.g., recycled from soda bottles). Thus, the incorporation of a recycled material into the PTT carpet fibers provides the desired effect of improving properties, such as spinnability and fire resistance, while simultaneously reducing the overall cost of the carpet fiber. Furthermore, this makes the prepared carpet more "earth friendly." Of course, the invention is not limited to the use of recycled PET. Rather, virgin PET (or a mixture of virgin and recycled PET) could be used to spin the novel carpet fiber. Moreover, the PET used in the carpet fibers of the invention can be substantially pure PET or can be a copolymer comprising one or more comonomers.

In further embodiments, the invention provides yarns, particularly carpet yarns, prepared from the fibers. Likewise, the invention provides carpets prepared from the fibers. Such yarns and carpets are particularly characterized by having improved spinnability and improved fire resistance.

In yet another aspect, the invention provides methods of improving various physical characteristics of polymer compositions. In certain embodiments, the invention provides methods for improving the ignition characteristic of polytrimethylene terephthalate compositions. In one embodiment, the method comprises preparing said composition to comprise a majority of a polytrimethylene terephthalate polymer and a minority of a polyethylene terephthalate polymer, based on the overall weight of the composition. In further embodiments, the invention provides methods for improving spinnability of polytrimethylene terephthalate compositions. In one embodiment, the method comprises adding an amount of polyethylene terephthalate such that the polyethylene terephthalate comprises about 3% by weight to about 15% by weight based on the overall weight of the polymer composition. In specific embodiments, spinnability is improved such that filament breakage during predetermined spinning conditions is reduced in comparison to filament breakage under the same conditions using a polytrimethylene terephthalate polymer composition without the polyethylene terephthalate. In yet further embodiments, the invention provides methods for improving the elongation of polytrimethylene terephthalate polymer compositions. In one embodiment, the method comprises adding an amount of polyethylene terephthalate such that the polyethylene terephthalate comprises about 3% by weight to about 15% by weight based on the overall weight of the polymer composition. In specific embodiments, elongation is improved such that there is a measurable percentage increase in the percent elongation in comparison to the percent elongation of a polytrimethylene terephthalate polymer composition without the polyethylene terephthalate.

DETAILED DESCRIPTION OF THE INVENTION

The present inventions now will be described more fully hereinafter with reference to specific embodiments of the invention. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present invention provides polymeric carpet fibers exhibiting improved properties. The improved properties arise from the blend of polymeric materials from which the carpet fibers are extruded. The polymeric blend comprises at least one first polymeric material providing properties generally desirable in a carpet fiber, such as strength, stain resistance, ease of dying, abrasion resistance, and durability. The polymeric blend further comprises at least one second polymeric material that, when combined with the first polymeric material, provides for improved properties in the fibers extruded from the polymeric blend. In preferred embodiments, the combination of the polymeric materials increases the fire resistance of fibers extruded from the polymeric blend. In further preferred embodiments, the combination of the polymeric materials increases the spinnability of fibers extruded from the polymeric blend.

In one embodiment, the carpet fiber of the invention comprises PTT as the first polymeric material and PET as the second polymeric material. The PTT component and the PET component can be blended in a variety of ratios to arrive at the final polymeric blend for extrusion into carpet fibers. The carpet fibers of the invention can be prepared using only PTT and PET in various combinations. Alternatively, the carpet fibers can be prepared from a mixture comprising various additional polymers or additives in addition to the PTT and PET components.

The improved properties obtainable in an extruded fiber prepared using the polymeric combinations of the invention can be determined based upon the relative percentages of the polymeric components. For example, certain improved properties can be obtained by using only a relatively small percentage of PET with the PTT. However, in further embodiments, additional improvements can be obtained by using relatively larger percentages of PET with the PTT. Moreover, in further embodiments, using PET in specific weight ratios with PTT can provide for improved properties wherein relatively higher PET ratios are used without sacrificing the improved properties obtained using relatively lower PET concentrations.

In one particular embodiment, PTT is the major polymeric component of the inventive carpet fiber and PET is a minor polymeric component of the carpet fiber. More specifically, the carpet fiber comprises greater than 50% by weight of PTT and less than 50% by weight of PET, based on the overall weight of the carpet fiber.

As previously noted, the carpet fiber of the invention is particularly beneficial in that improved fire resistance can be achieved with varying amounts of PET added to the PTT carpet fiber. For example, in one embodiment, the carpet fiber of the invention can comprise up to about 30% by weight of PET based on the overall weight of the carpet fiber. In further embodiments, the carpet fiber can comprise up to about 25% by weight of PET, up to about 20% by weight PET, up to about 15% PET, or up to about 10% PET, based on the overall weight of the carpet fiber.

In further embodiments, the inventive carpet fiber can include PET in specific ranges. For example, in one embodiment, the carpet fiber can comprise from about 1% by weight to about 30% by weight of PET, based on the overall weight of the carpet fiber. In further embodiments, the carpet fiber can comprise from about 3% to about 20% by weight of PET, about 5% to about 15% weight of PET, about 7% to about 15% by weight of PET, or about 10% to about 15% by weight of PET, based on the overall weight of the carpet fiber.

In further embodiments, the carpet fiber of the invention is particularly beneficial in that improved spinnability can be achieved with varying amounts of PET added to the PTT carpet fiber. For example, in one embodiment, the carpet fiber of the invention can comprise about 1% to about 20% by weight of PET, about 2% to about 18% by weight of PET, about 3% to about 15% by weight of PET, about 5% to about 15% by weight of PET, or about 7% to about 15% by weight of PET based on the overall weight of the carpet fiber.

The PET component of the inventive carpet fiber can comprise a PET homopolymer. In further embodiments, the PET component can comprise a copolymer, wherein one or more different monomers can be included. Any comonomer recognized as being useful in preparing a polymer useful as a carpet fiber could be used according to the present invention, particularly any comonomer useful for imparting useful properties to a formed polymer, such as improved spinnability or improved fire resistance.

In one particular embodiment, the PET used in preparing the inventive carpet fiber is a copolymer comprising ethylene terephthalate monomers and 1,4-cyclohexane dimethanol (CHDM) monomers. Preferably, the copolymer comprises a majority of ethylene terephthalate monomers and a minority of CHDM monomers. A PET polymer including a percentage of CHDM may be known as PETG.

In specific embodiments, the PET component of the invention comprises up to about 30 mole % of CHDM comonomers. In still further embodiments, the PET component of the invention comprises up to about 25 mole %, about 20 mole %, about 15 mole %, about 10 mole %, about 5 mole %, about 4 mole %, about 3 mole %, about 2 mole %, or about 1 mole % of CHDM comonomer.

In addition to CHDM, the PET component of the invention can comprise further monomeric or polymeric units. In particular embodiments, the PET component of the invention comprises components such as those commonly found in PET used in bottling compositions. For example, the further units can comprise various diacids or diols. In specific embodiments, the further units can comprise one or more isophthalic acids, including sulfonated isophthalic acids. Still further examples of monomeric or polymeric units useful in PET according to the invention include diethylene glycol, polyethylene glycol, butylene glycol, polystyrene, vinyltoluene, halostyrene, dihalostyrene, styrene-butadiene copolymers, styrene-acrylonitrile copolymers, styrene-acrylonitrile-butadiene terpolymers, styrene-butadiene-styrene terpolymers, styrene-isoprene copolymers, aromatic dicarboxylic acids (e.g., 5-sodium sulfoisophthalic acid), aliphatic dicarboxylic acids (e.g., adipic acid and itaconic acid), glutaric acid, azelaic acid, sebacic acid and combinations thereof. In addition to these monomeric or polymeric units, branching agents like trimesic acid, pyromellitic acid, trimethylolpropane and trimethylolethane, and pentaerythritol may be used.

These monomeric or polymeric units may be included in the PET component that is added to the PTT. In further embodiments, such monomeric or polymeric units may be incorporated directly into the PTT composition separate from the PET component. Such components can be incorporated using techniques known in the art, such as, condensation polymerization techniques.

Similarly, the PTT component of the inventive carpet fiber polymer can comprise a PTT homopolymer or can comprise a copolymer (e.g., formed of trimethylene terephthalate monomers and one or more comonomers). In a preferred embodiment, the PTT used in the invention comprises a PTT homopolymer.

PTT is a polyester, the acid component of which is terephthalic acid and the diol component of which is 1,3-propanediol. Non-limiting examples of further copolymer components that may be used in the PTT according to the invention include ester-forming monomers such as 5-sodium sulfoisophthalic acid, 5-potassium sulfoisophthalic acid, 4-sodium sulfo-2,6-naphthalenedicarboxylate, tetramethylphosphonium-3,5-dicaroboxybenzenesulfonate, tetrabutylphosphonium 3,5-dicarboxybenzenesulfonate, tributylmethylphosphonium 3,5-dicarboxybenzenesulfonate, tetrabutylphoshonium 2,6-dicarboxynaphthalene-4-sulfonate, tetramethylphosphonium 2,6-dicarboxynaphthalene-4-sulfonate, ammonium 3,5-dicarboxybenzenesulfonate, 1,2-butanediol, 1,3-butanediol, 1,4-butanediol, neopentyl glycol, 1,5-pentamethylene glycol, 1,6-hexamethylene glycol, heptamethylene glycol, octamethylene glycol, decamethylene glycol, dodecamethylene glycol, 1,4-cyclohexanediol, 1,3-cyclohexanediol, 1,2-cyclohexanediol, 1,4-cyclohexanedimethanol, 1,3-cyclohexanedimethanol, 1,2-cyclohexanedimethanol, oxalic acid, malonic acid, succinic acid, glutaric acid, adipic acid, heptanedioic acid, octanedioic acid, sebacic acid, dodecanedioic acid, 2-methylglutaric acid, 2-methyladipic acid, fumaric acid, maleic acid, itaconic acid, 1,4-cyclohexanedicarboxylic acid, 1,3-cyclohexanedicarboxylic acid, and 1,2-cyclohexanedicarboxylic acid.

Additionally, the PTT component can comprise PTT belonging to one or more different types of PTT polymer. For example, the PTT polymer can comprise SORONA® PTT (available from E.I. Du Pont de Nemours), CORTERRA® PTT (available from Shell Chemicals), other PTT polymers, or combinations thereof. PTT is generally produced by the polycondensation reaction of purified terephthalic acid (PTA) and 1,3-propanediol (PDO). CORTERRA® PTT is produced solely by chemical reaction, while SORONA® PTT is biochemically produced using PDO obtained by bacterial metabolism of glucose.

The polymeric compositions of the present invention may further comprise other components, such as, without limitation, finishing agents, delusterants, viscosity boosters, optical brighteners, matting agents (e.g., titanium oxide), thermal stabilizing agents (e.g., phosphorous compounds), anti-oxidative agents (e.g., hindered phenol), anti-static agents, pigments, ultra-violet blocking agents, and combinations thereof. See, for example, U.S. Pat. No. 6,921,803, which is incorporated herein by reference in its entirety.

The usefulness of the inventive carpet fiber polymeric blend is particularly surprising in that the fire resistance of the PTT carpet fiber is increased through addition of another polymeric component. Accordingly, while traditional flame retardants could still be included in the inventive carpet fiber, increased fire resistance is achieved in the present invention without the necessity of such traditional flame retardants. Thus, the present invention provides a carpet fiber that, through the incorporation of a PET component, provides a carpet fiber exhibiting increased fire resistance in comparison to a like carpet fiber without PET.

Increased fire resistance, in one embodiment, is exemplified by improvement in an ignition characteristic of the carpet fiber, or a carpet prepared using the carpet fiber. One test used to evaluate fire resistance is ASTM D-2859 (also known as the "Methenamine Pill Test"), which provides a standardized method for the determination of the flammability of finished textile floor covering materials when exposed to an ignition source under controlled laboratory conditions. Specifically, a 9-by 9-inch steel frame with an 8-inch-diameter hole is placed over a 12-by 12-inch carpet sample. A methenamine pill is then placed in the center and ignited. To pass the test, the charred area caused by ignition of the pill must not extend to within 1 inch of the hole's edge at any point for a specified number of samples.

As further described in Example 1, a carpet prepared using the inventive carpet fiber exhibits improved ignition characteristics in comparison to a carpet prepared from PTT fibers alone. Accordingly, in another embodiment, the present invention also provides a method of increasing the fire resistance of a carpet fiber. More specifically, the invention provides a method for improving the ignition characteristic of a carpet fiber according to ASTM D-2859.

In further embodiments, the polymeric combinations according to the invention provide carpet fiber having improved spinnability. As used herein, "improved spinnability" includes, without limitation, improving the continuity of a spinning process, reducing fiber or filament breakage, reducing dusting (or formation of dust) during spinning, and reducing fiber or filament hairiness.

Thus, in one aspect, the invention is directed to methods for improving the spinnability of a PTT polymer composition. In specific embodiments, the method comprises adding PET to the PTT in an amount of PET effective for improving the spinnability of the polymer composition. The PET concentration useful in the method can be in the ranges described herein in relation to the inventive composition. In preferred embodiments, spinnability is improved such that filament breakage during predetermined spinning conditions is reduced in comparison to filament breakage under the same conditions using a PTT composition without the PET.

Particularly, the polymeric combination of the invention is useful for improving spinnability of a PTT composition by reducing breakage or fiber hairiness, or both, of a PTT fiber or filament. In specific embodiments, fiber breakage may be reduced by more than 10%, more than 20%, more than 30%, more than 40%, more than 50%, more than 60%, or more than 70%. In further embodiments, fiber breakage may be reduced by about 10% to about 70% or about 30% to about 70%.

Improved spinnability of the PTT fiber is further exemplified by a measurable increase in the percent elongation of PTT fiber incorporating PET. The percent elongation of the PTT fiber directly relates to the spinnability of the fiber because a greater percentage elongation is a key indicator of the toughness of the fiber (i.e., a tougher fiber, when under stress, will be able to elongate—or stretch—rather than break). Tougher fibers spin better in light of their increased ability to resist breakage. In specific embodiments, the percent change in elongation can be evaluated as the percentage elongation of a fiber according to the invention comprising a combination of PTT and PET in comparison to a fiber formed of PTT without PET. Preferably, the inventive fiber exhibits a percent change (increase) in elongation in the range of about 5% to about 20% in comparison to a PTT fiber without PET. In further embodiments, the inventive fiber exhibits a percent change (increase) in elongation in the range of about 8% to about 18%, or about 10% to about 18%.

In another aspect, the invention provides methods for improving the elongation a PTT polymer composition. In specific embodiments, the method comprises adding PET to the PTT in an amount of PET effective for improving the elongation of the polymer composition. The PET concentration useful in the method can be in the ranges described herein in relation to the inventive composition.

In one particular embodiment, the methods of the invention comprises adding an amount of PET to a PTT composition and extruding said PTT and PET blend to make a carpet fiber. The PET component and the PTT component can be dry blended prior to feeding the blend to an extruder. Alternatively, the polymeric components may be fed directly to the extruder in any order provided there is sufficient residence time in the extruder to assure thorough essentially homogeneous mixing of the polymeric components. Moreover, a preblended, essentially homogeneous mixture of polymeric components may also be fed to an extruder.

Methods for extruding and spinning PTT are known in the art. See, for example, U.S. Pat. Nos. 6,284,370, 6,423,407, 6,620,502, 6,682,815, 6,692,671, 6,752,945, and 6,921,803, all of which are incorporated herein by reference in their entirety.

The polymeric blend can be extruded to have any shape or dimension suitable to polymeric carpet fibers. Moreover, the carpet fibers can undergo any post-spinning processes generally recognized as useful in the preparation of polymeric carpet fibers. By "fibers", reference is made to items, recognized in the art as fibers, such as continuous filaments, monofilaments, staple fibers, and the like. The fibers can be round or have other shapes, such as octalobal, delta, sunburst (also known as sol), scalloped oval, trilobal, tetra-channel (also known as quatra-channel), scalloped ribbon, ribbon, starburst, and the like. The fibers may also be solid, hollow, or multi-hollow. The fibers can be used to make yarns, and the fibers or yarns can be used to prepare a number of materials, particularly carpets, rugs, mats, and the like.

In one embodiment, the invention provides yarns prepared using the fibers described herein. The yarns may be prepared according to any method for preparing yarns recognized in the art as being useful therefore. For example, the yarn of the invention could be partially oriented yarn, spun drawn yarn, textured yarn, friction false-twisted yarn, and bulk continuous filament ("BCF") yarn. Partially oriented and friction false-twisted yarns of PTT are described in U.S. Pat. Nos. 6,287,688 and 6,333,106; BCF yarns are described in U.S. Pat. Nos. 5,645,782, 6,109,015,and 6,113,825, all of the above being incorporated herein by reference. Preferred steps in preparing BCF yarn includes spinning (e.g., extruding, cooling, and coating filaments), single stage or multi-stage drawing (such as with heated rolls, heated pin or hot fluid assist) at a defined temperature and draw ratio, annealing, bulking, entangling, optionally relaxing, and winding the filaments on a package for subsequent use.

Yarns prepared according to the present invention exhibit physical properties similar to the properties of yarns prepared from fibers consisting of PTT as the only polymeric component. Table 1 provides a comparison of tenacity (grams/denier) and elongation (%) for yarns according to the present invention (a blend of PTT and 15% by weight PET) and yarns made of PTT fibers. The comparison includes BCF yarn, non-heat set (NHS) yarn, and heat set (HS) yarn.

TABLE 1

| | BCF Yarn | | NHS Yarn | | HS Yarn | |
|---|---|---|---|---|---|---|
| Yarn Property | PTT | PTT/15% PET | PTT | PTT/15% PET | PTT | PTT/15% PET |
| Denier | 1469 | 1470 | 3005 | 3007 | 3199 | 3203 |
| Tenacity | 2.04 | 2.08 | 1.9 | 2.01 | 1.7 | 2.1 |
| Elongation | 43.19 | 43.4 | 48.98 | 49.02 | 55.33 | 62.18 |

As seen above, yarns prepared according to the present invention exhibited similar physical properties to yarns of like size (denier) prepared using fibers formed with PTT as the only polymeric component. In fact, in each case, the inventive yarns exhibited increased tenacity.

The fibers of the invention can likewise be made into staple fibers of varying lengths. Such staple fibers can be used for a variety of products, including carpets.

In another embodiment of the invention, carpets, rugs, mats, and the like, can be prepared using the inventive fibers. Any method of preparing a carpet from a fiber known in the art could be used in preparing carpets according to the invention. For example, BCF yarns are typically used to prepare all types of carpets, as well as textiles, and methods of preparing carpets from BCF yarn are described in the foregoing references. Typically, a number of yarns are cable twisted together and heat set in a device such as an autoclave, and then tufted into a primary backing. Latex adhesive and a secondary backing are then applied. Carpets according to the present invention can likewise be made from non-BCF yarns, such as spun yarns.

The fibers of the present invention are particularly useful in the preparation of carpets arising from the increased fire resistance of the fibers. Accordingly, a carpet according to the present invention likewise has an increased fire resistance. More particularly, a carpet according to the present invention (i.e., formed from fibers comprising a blend of PTT and PET) exhibits an improved ignition characteristic according to ASTM D-2859 in comparison to a carpet prepared from fibers comprising PTT alone.

The present invention will be further illustrated by the various examples. The following examples are provided to illustrate specific embodiments of the invention and are not to be construed as limiting the scope of the invention. Rather, various further embodiments, modifications, and equivalents thereof are encompassed by the present invention.

EXAMPLE 1

Comparison of Ignition Characteristic of Carpet Samples

The effect of including PET in a PTT fiber-based carpet was evaluated by comparing the ignition characteristic of various carpet samples. The carpet samples were evaluated according to the standards of ASTM D-2859 using the Methenamine Pill Test.

Test sample 1 was carpet prepared with fibers consisting of PTT as the only polymeric component. Test sample 2 was a carpet according to the present invention prepared using fibers comprising PTT blended with 15% by weight PET, based on the overall weight of the fibers. The PET comprised a PET/CHDM copolymer available from Eastman Chemical under the product name F80CC (intrinsic viscosity of 0.80+/−0.02 dL/g). Test sample 3 was a carpet prepared with fibers consisting of PTT as the only polymeric component and including the flame retardant TINUVIN® FR (available from CIBA® Specialty Chemicals).

A number of tests were performed on all three samples, and upon completion of each test, the sample was given a score of either "pass" or "fail". The results of the tests performed on the carpet samples are provided below in Table 2.

TABLE 2

| Sample Fiber Composition | Number of Tests | Number of Pass | Pass Percentage |
|---|---|---|---|
| PTT alone | 128 | 34 | 26.6% |
| PTT with 15% by wt. PET | 64 | 30 | 46.9% |
| PTT with TINUVIN ® FR | 64 | 9 | 14.1% |

As seen from the results provided in Table 2, carpet prepared according to the present invention significantly out performs carpet prepared from fibers consisting of PTT as the sole polymeric component. Moreover, the inventive carpet also out performed carpet prepared from fibers consisting of PTT fiber including a commercial flame retardant.

EXAMPLES 2-5

Spinnability of SORONA® PTT with Varying PET Concentrations

Spinnability of SORONA® PTT resin using PTT alone and varying concentrations of PET was evaluated. Spinning conditions are provided below in Table 3. Generally, spinning was carried out under the conditions provided below in Table 3, and break and elongation properties were evaluated. In particular, note was made of the number of breaks per hour of spinning, the percent change in the number of breaks per hour, the percent elongation of the spun filament, and the percent change in elongation. These properties are summarized for each example in Table 4 below. Changes in breaks per hour and elongation are compared as the compositions incorporating PET in comparison to the control using no PTT (Example 2). As used herein, a breakout is defined as any unplanned of a continuous threat-line being produced requiring restringing of the thread-line on the position faceplate.

TABLE 3

| Condition | Example 2 | Example 3 | Example 4 | Example 5 |
|---|---|---|---|---|
| PET Concentration | 0% | 3% | 5% | 7% |
| Feed Tension (g) | 275 | 265 | 270 | 260 |
| Draw Tension (g) | 1050 | 1041 | 1070 | 1040 |
| Transport Roll Speed (mpm) | 56 | 56 | 59 | 59 |
| Cooling Drum Speed (mpm) | 83 | 83 | 83 | 83 |
| Winder Speed (mpm) | 2751 | 2751 | 2751 | 2751 |
| Screw Speed (rpm) | 37.3 | 37.8 | 37.8 | 37.8 |
| Melt Head Pressure (bar) | 115 | 115 | 115 | 115 |
| Melt Head Temperature (° C.) | 255 | 255 | 255 | 255 |

TABLE 4

| Condition | Example 2 | Example 3 | Example 4 | Example 5 |
|---|---|---|---|---|
| PET Concentration | 0% | 3% | 5% | 7% |
| Number of breaks per hour | 1.243 | 0.443 | | 0.392 |
| % change of breaks per hour | | −64.36 | | −68.46 |
| % elongation | 41.08 | 45.24 | 45.04 | 44.37 |
| % change in elongation | | 10.13 | 9.64 | 8.01 |

EXAMPLE 6

Spinnability of SORONA® PTT with 15% PET

In a further example, the spinnability of SORONA® PTT with 15% PET was evaluated using the same methods as described above. Over the testing period, zero breaks were recorded. The percent elongation of the PTT polymer with 15% PET was 51.12%, indicating a 18.01% change in elongation percentage over PTT with no PET added.

Many modifications and other embodiments of the inventions set forth herein will come to mind to one skilled in the art to which these inventions pertain having the benefit of the teachings presented in the foregoing descriptions. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A carpet yarn comprised of bulk continuous filaments comprising a polymeric blend of polytrimethylene terephthalate polymer and about 1% by weight to about 15% by weight of a polyethylene terephthalate polymer, based on the overall weight of said carpet yarn, wherein the yarn exhibits an increase in elongation in comparison to a carpet yarn comprised of polytrimethylene terephthalate polymer having an identical composition with the exception that the comparison carpet yarn has no polyethylene terephthalate polymer, and wherein the polyethylene terephthalate polymer has an intrinsic viscosity of 0.80+/−0.02 dL/g.

2. The carpet yarn of claim 1 comprising about 3% by weight to about 15% by weight of said polyethylene terephthalate polymer, based on the overall weight of said yarn.

3. The carpet yarn of claim 1 comprising about 5% by weight to about 15% by weight of said polyethylene terephthalate polymer, based on the overall weight of said yarn.

4. The carpet yarn of claim 1 comprising about 10% by weight to about 15% by weight of said polyethylene terephthalate polymer, based on the overall weight of said yarn.

5. The carpet yarn of claim 1, wherein said polyethylene terephthalate polymer is a copolymer comprising a content of 1,4-cyclohexane dimethanol comonomers.

6. A carpet comprising a carpet yarn according to claim 1.

7. The carpet yam of claim 1, wherein said yarn exhibits improved ignition characteristics according to ASTM D-2859 in relation to a like carpet yam consisting of a polytrimethylene terephthalate polymer without a polyethylene terephthalate polymer.

8. A method for increasing fire resistance of a carpet prepared using a polytrimethylene terephthalate yarn, said method comprising preparing the carpet using a yarn comprised of bulk continuous filaments comprising a melt blend of polytrimethylene terephthalate polymer and about 1% by weight to about 30% by weight of a polyethylene terephthalate copolymer including a content of 1,4-cyclohexane dimethanol comonomers, wherein said carpet exhibits increased fire resistance when tested according to ASTM D-2859 in relation to a like carpet prepared using a polytrimethylene terephthalate polymer without the polyethylene terephthalate copolymer, and wherein the yarn exhibits an increase in elongation in comparison to a carpet yarn comprised of polytrimethylene terephthalate polymer and having no polyethylene terephthalate polymer, and wherein the polyethylene terephthalate polymer has an intrinsic viscosity of 0.80+/−0.02 dL/g.

9. The carpet yarn of claim 8 comprising about 5% by weight to about 15% by weight of said polyethylene terephthalate copolymer, based on the overall weight of said yarn.

10. The carpet yarn of claim 8 comprising about 10% by weight to about 15% by weight of said polyethylene terephthalate copolymer, based on the overall weight of said yarn.

11. The carpet yarn of claim 8, wherein said polyethylene terephthalate copolymer comprises up to about 30 mole % of 1,4-cyclohexane dimethanol comonomers.

12. The method of claim 8, wherein said increased fire resistance comprises a pass rate of test ASTM D-2859 of greater than about 27%.

13. The method of claim 8, wherein said increased fire resistance comprises a pass rate of test ASTM D-2859 of at least about 46%.

14. The carpet fiber of claim 1, wherein the fibers have a tenacity of 2.08 grams/denier.

15. A carpet yarn comprised of bulk continuous filaments comprising a polymeric blend of polytrimethylene terephthalate polymer and about 1% by weight to about 15% by weight of a polyethylene terephthalate copolymer, based on the overall weight of said carpet yarn, wherein the yarn exhibits an increase in elongation in comparison to a carpet yarn comprised of polytrimethylene terephthalate polymer having an identical composition with the exception that the comparison carpet yarn has no polyethylene terephthalate polymer.

16. The carpet yarn of claim 15, wherein the polyethylene terephthalate copolymer comprises ethylene terephthalate monomers and a 1,4-cyclohexane dimethanol (CHDM) comonomer.

17. The carpet yarn of claim 15, wherein the polyethylene terephthalate copolymer comprises ethylene terephthalate monomers and comonomers comprised of diacids or diols.

18. The carpet yarn of claim 15, wherein the polyethylene terephthalate copolymer comprises ethylene terephthalate monomers and comonomers selected from the group consisting of diethylene glycol, polyethylene glycol, butylene glycol, polystyrene, vinyltoluene, halostyrene, dihalostyrene, styrene-butadiene copolymers, styrene-acrylonitrile copolymers, styrene-acrylonitrile-butadiene terpolymers, styrene-butadiene-styrene terpolymers, styrene-isoprene copolymers, aromatic dicarboxylic acids, aliphatic dicarboxylic acids, glutaric acid, azelaic acid, sebacic acid and combinations thereof.

19. The carpet yarn of claim 15, wherein the polyethylene terephthalate copolymer comprises recycled polyethylene terephthalate.

20. A carpet yarn comprised of bulk continuous filaments consisting of a polymeric blend of polytrimethylene terephthalate polymer and about 1% by weight to about 15% by weight of a polyethylene terephthalate copolymer, based on the overall weight of said carpet yarn, wherein said yarn exhibits improved ignition characteristics according to ASTM D-2859 in relation to a like carpet yarn consisting of a polytrimethylene terephthalate polymer without a polyethylene terephthalate copolymer.

21. The carpet yarn of claim 20, wherein the polyethylene terephthalate copolymer comprises ethylene terephthalate monomers and a 1,4-cyclohexane dimethanol (CHDM) comonomer.

22. A carpet yarn comprised of bulk continuous filaments comprising a polymeric blend of polytrimethylene terephthalate polymer and about 1% by weight to about 15% by weight of a polyethylene terephthalate polymer, based on the overall weight of said carpet yarn, wherein the yarn exhibits an increase in elongation in comparison to a carpet yarn comprised of polytrimethylene terephthalate polymer having an identical composition with the exception that the comparison carpet yarn has no polyethylene terephthalate polymer.

23. The carpet yarn of claim 22, comprising about 3% by weight to about 15% by weight of said polyethylene terephthalate polymer, based on the overall weight of said yarn.

24. The carpet yarn of claim 22, wherein said yarn exhibits improved ignition characteristics according to ASTM D-2859 in relation to a like carpet yarn consisting of a polytrimethylene terephthalate polymer without a polyethylene terephthalate polymer.

25. The carpet yarn of claim 24, wherein said improved ignition characteristics comprises a pass rate of test ASTM D-2859 of greater than about 27%.

26. The carpet yarn of claim 24, wherein said improved ignition characteristics comprises a pass rate of test ASTM D-2859 of at least about 46%.

* * * * *